United States Patent [19]

Lynch

[11] Patent Number: 5,074,226

[45] Date of Patent: Dec. 24, 1991

[54] FLUE GAS CONDITIONING SYSTEM

[75] Inventor: Jerome G. Lynch, Trumbull, Conn.

[73] Assignee: Field Service Associates, Inc., Shelton, Conn.

[21] Appl. No.: 656,957

[22] Filed: Feb. 15, 1991

[51] Int. Cl.[5] ..... F23D 1/00; F23J 15/00

[52] U.S. Cl. ..... 110/345; 110/216; 55/5; 55/105

[58] Field of Search ..... 110/215, 216, 345, 344, 110/343, 185, 186; 55/2.5, 105; 431/215, 242

[56] References Cited

U.S. PATENT DOCUMENTS

| | | | |
|---|---|---|---|
| 4,070,424 | 1/1978 | Olson et al. | 55/5 |
| 4,208,192 | 6/1980 | Quigley et al. | 55/5 |
| 4,333,746 | 6/1982 | Southam | 55/5 |
| 4,533,364 | 8/1985 | Altman et al. | 55/5 |
| 4,547,351 | 10/1985 | Im et al. | 55/5 |
| 4,813,978 | 3/1989 | Hirth et al. | 55/5 |
| 4,872,887 | 10/1989 | Altman et al. | 55/5 |
| 4,929,173 | 5/1990 | Jacobs et al. | 431/215 |
| 4,987,839 | 1/1991 | Krigmont et al. | 55/5 |
| 5,002,481 | 3/1991 | Forster | 431/242 |
| 5,015,173 | 5/1991 | Fullemann et al. | 431/242 |

*Primary Examiner*—Henry C. Yuen

*Attorney, Agent, or Firm*—John R. Doherty

[57] ABSTRACT

A gas conditioning system for reducing the electrical resistance of finely-divided fly ash particles entrained within a flue gas stream resulting from the burning of low sulfur coal and for enhancing the removal of the fly ash particles by electrostatic precipitation wherein an acid conditioning agent, e.g., sulfuric acid, is passed through a vaporizing coil mounted within an enclosure defining a mixing chamber downstream from the coil and is vaporized by a stream of hot air passing over the coil and into the mixing chamber. The vaporized acid exits the coil and mixes with the hot air in the mixing chamber and the resulting mixture is injected into the flue gas stream so that the acid vapor can condense on the fly ash particles.

20 Claims, 7 Drawing Sheets

Fig. 15
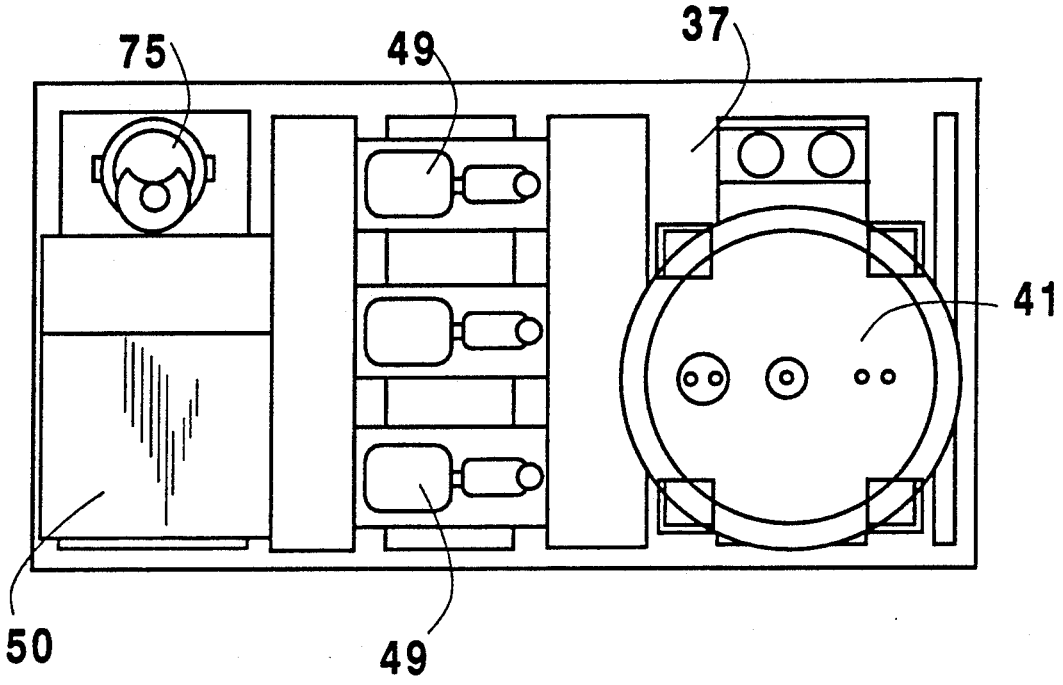
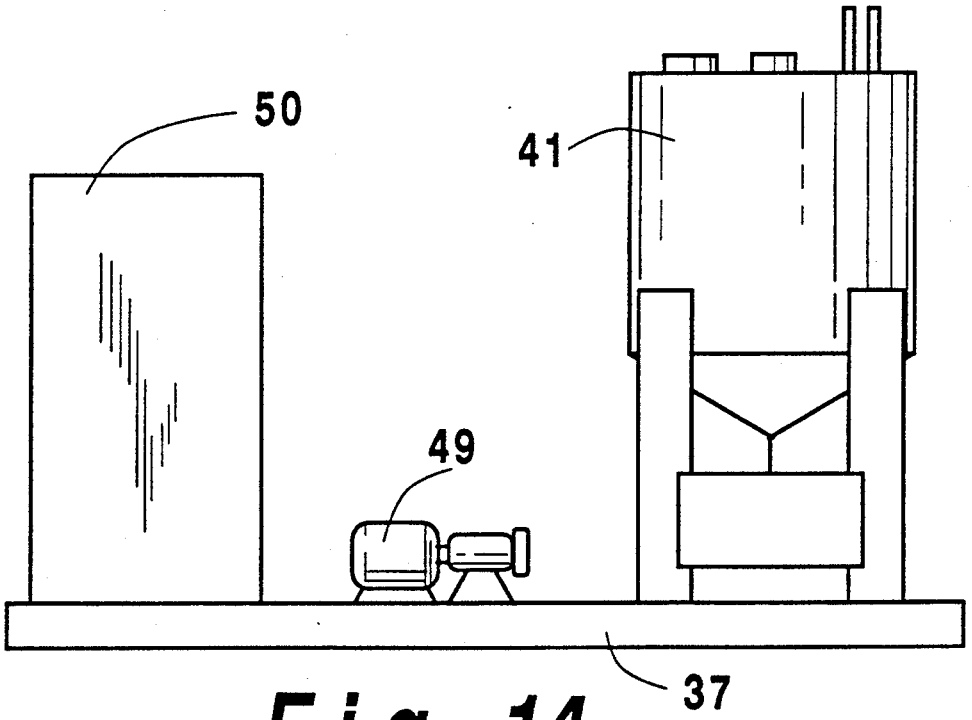
Fig. 14

FLUE GAS CONDITIONING SYSTEM

BACKGROUND OF THE INVENTION

This invention relates generally to flue gas conditioning systems and more particularly to an improved method and apparatus for introducing an acid conditioning agent into a flue gas stream for enhancing the removal of finely-divided fly ash particles by electrostatic precipitation.

Many industrial and utility companies employ coal fired boilers in their power plants. In an effort to comply with todays strict emissions standards, a number of these companies have switched to the use of low sulfur coal to reduce the amount of sulfur dioxide present in the flue gases. Unfortunately, the use of low sulfur coal in these boiler plants lowers the amount of sulfur trioxide which naturally occurs in the flue gas stream. The presence of sulfur trioxide is known to develop a sufficiently low resistivity in the fine fly ash particles to promote their efficient removal from the flue gas by electrostatic precipitation.

In an effort to restore the level of sulfur trioxide to that developed in the flue gas when using high sulfur coal, many industrial and utility companies employing coal fired boilers are now resorting to the use of flue gas conditioning systems. These systems are designed to bring the exhaust fly ash resulting from the combustion of low sulfur coal into a range of resistivity which is more desirable for removal by electrostatic precipitation. Gas conditioning is far more attractive from an economic standpoint when compared to the cost of installing new and larger precipitators that would otherwise be required to handle the flue gas resulting from the burning of low sulfur coal.

Various flue gas conditioning systems and methods have heretofore been proposed. For example, L. C. Hardison, et al U.S. Pat. No. 3,704,569, discloses a system which uses vaporized sulfuric acid as a conditioning agent. In this system, large volumes of dry air are heated to a temperature of approximately 260 degrees C to vaporize the sulfuric acid, which is mixed with the air in a glass lined chamber filled with dispersion packing. Since the glass and gasket material that is employed in this system limit the temperature to not more than about 260 degrees C, the acid is evaporated, rather than boiled, in the air stream. The hot vaporized acid is uniformly dispersed in the flue gas stream by means of injection lances, the vaporized acid being conveyed to the lances using glass lined manifold pipes. Although this system provides effective conditioning of the flue gas, it is nevertheless expensive, primarily because the acid must be transported over long distances in a hot vaporized state. The vaporized acid is, of course, extremely corrosive and requires the use of expensive, corrosion-resistant materials. Moreover, the system consumes large amounts of electrical energy in order to heat the large volumes of dry air that are required to evaporate the acid into the air stream.

Gas conditioning can also be carried out by introducing hot, vaporized sulfur trioxide directly into the flue gas stream. However, the sulfur trioxide is extremely difficult to handle since it must be heated to remain liquid and can solidify in piping systems if the heating should fail. When reheated, the solidified material becomes an extremely corrosive gas under high pressure which can rupture the piping. Moreover, the resulting gas forms fuming sulfuric acid with atmospheric moisture. For these reasons, the direct addition of sulfur trioxide would not be a commercially viable process.

Another proposal for gas conditioning is that of burning liquid sulfur. The sulfur dioxide that is generated by burning sulfur is passed through a catalyst which converts the sulfur dioxide to sulfur trioxide. The latter is introduced into the flue gas stream where it combines with the moisture in the flue gas to form sulfuric acid. The sulfuric acid conditions the fly ash as indirect sulfuric acid injection. Another variation is to heat liquid sulfur dioxide to a vapor, pass it through a catalyst that converts it to sulfur trioxide, and disperse the sulfur trioxide in the flue gas as in the aforementioned method.

W. I. Olson, et al U.S. Pat. No. 4,070,424, discloses a flue gas conditioning system utilizing high energy compressed air acoustic atomizing nozzles to produce an extremely fine mist of liquid sulfuric acid which is then vaporized in the surrounding hot flue gas or air. A number of the nozzles are positioned in the inlet duct to the precipitator, which sprays sulfuric acid directly into the flue gas stream. However, the problem with this system is that under normal gas flow conditions, the newly atomized plume of sulfuric acid can collapse and cause reaglomeration of the acid mist into larger droplets which fail to vaporize, wetting the internal duct structure and causing undesirable ash build-up and corrosion.

W. A. Quigley, et al U.S. Pat. No. 4,208,192, discloses a similar system which utilizes high energy compressed air acoustic nozzles to inject a fine mist of acid into a slip stream of hot air where the acid is vaporized in a large cyclonic flow chamber. The resulting vaporized acid/-hot air mix is then injected into the inlet duct upstream of the precipitator. The problem with this system is that it requires apparatus which is very bulky and less efficient in the use of vaporizing energy and compressed plant air.

It is therefore an important object of the invention to provide an improved flue gas conditioning system which is more efficient and less costly than the known systems of the prior art.

Another more specific object of the invention is to provide an improved method and apparatus for introducing an acid conditioning agent into a flue gas stream in vaporized form in order to develop a more desirable resistivity in the finely-divided fly ash particles to promote their removal by electrostatic precipitation.

SUMMARY OF THE INVENTION

The present invention is directed to an improved flue gas conditioning system which makes it possible to remove finely-divided fly ash particles from a flue gas stream at performance levels which are at least equivalent to those of the prior art but which can be attained at much lower capital equipment and operating costs. Basically, the gas conditioning system of the invention involves the use of an efficient heat exchanger coil for vaporizing a liquid acid conditioning agent, e.g., sulfuric acid. The heat exchanger coil is mounted within an enclosure defining a mixing chamber downstream from the coil, the coil having an outlet communicating with the mixing chamber. The liquid acid conditioning agent is fed through the heat exchanger coil where the acid is vaporized by heat transferred through the coil from a stream of hot air flowing over the coil. The vaporized acid and hot air are mixed together in the mixing chamber and the resulting vapor/hot air mixture is then dispersed into contact with the flue gas stream at a point upstream from the electrostatic precipitator. The coil is preferably located within the rearward end portion of an injection lance assembly which forms the enclosure for the vaporizing coil separating it from the flue gas stream. The injection lance assembly is preferably inserted in the flue duct leading to the precipatator and includes at least one orifice for distributing the acid vapor/hot air mixture into the flue gas stream. This system has a distinct advantage over the prior art in that the highly corrosive acid vapor is carried inside the coil and lance assembly, rather than in an extensive piping network leading up to the injection lance. Thus, the air pipe can be made of low cost carbon steel up to its connection to the lance assembly at the duct wall. Prior art systems have required much more expensive stainless steel, glass lined pipe, or other exotic material, to transport the acid vapor mixture to the lance assembly from the vaporizing device, which could be some distance away.

The liquid acid conditioning agent, e.g., sulfuric acid, is relatively easy to handle at ambient temperature and can be contained by acid resistant plastic lined or stainless steel pipe. This reduces equipment bulk, cost, and risk of injury due to contact with the hot acid piping. Only the vaporizing coil need be fabricated from corrosive resistant material, e.g., tantalum, which can accommodate the acid at boiling temperatures. The vaporizing coil can be made of small diameter tubing of sufficient length to obtain the required residence time and heat transfer from the hot air flowing over the outside of the coil to the cooler acid flowing inside the coil. The source of hot air for the system can be readily obtained from the preheater device employed in the combustion unit. The temperature of the hot air should be well above the boiling temperature of the acid conditioning agent that is required within the injection lance assemblies. Typically, in the case of sulfuric acid, the temperature should be kept above about 550 degrees F in order to effectively vaporize the acid, to avoid localized condensation of acid vapor and to maintain the acid in the vapor state from the mixing chamber to the end of the injection lance assembly from whence the acid vapor is emitted into the inlet duct of the precipitator. In most power plant applications, the hot air supply will be under sufficient pressure from the forced and induced draft plant combustion air fans to flow over the coil and into the flue duct without any additional fan or blower required. In those limited cases where the existing pressure differential is not sufficient, an additional fan can be used. However, the savings gained by using air from the preheater far outweigh the small additional energy cost that may be incurred by using the additional fan. The volume of air required is quite small compared to the available volume. As one illustration, a typical coil requires approximately only 500 SCFM of air to vaporize 3 gallons per hour (GPH) of acid. In a typical power plant boiler, flue gas leaves the boiler at a temperature of approximately 750 degrees F. The flue gas passes through an air preheater which typically heats ambient outside air passing through the preheater to a temperature of approximately 650 degrees F. Due to the heat transferred in the preheater, the temperature of the flue gas is lowered to approximately 350 degrees F before entering the duct leading to the electrostatic precipitator. The acid flow rate mentioned above (i.e., 3 gallons per hour) is sufficient to treat a flue gas volume of approximately 115,000 SCFM. There are, of course, boilers with a much larger volume of flue gas. For instance, a 360 megawatt boiler could have a total flue gas volume of 845,000 SCFM. With such a unit, eight vaporizing coils might well be required. Since such a boiler would have a large flue duct, a number of injection lances with a plurality of orifices would be required to achieve good vapor distribution. Typically, the same number of lances and coils would be used for good vapor distribution so that the coils and lances remain as a unit. Thus, an efficient distribution of acid vapor can be achieved with lower cost and a vapor injection apparatus which is far less complicated.

In operation, a liquid acid conditioning agent, e.g., 93%-94% sulfuric acid, is taken from a day storage tank, filtered and then pumped into the system at controlled rates. In response to a system feed control signal, a volume of acid corresponding to the desired injection rate, is delivered to the individual vaporizing coils. The acid then passes from the metering equipment through flow indicating transducers by means of which the operator can monitor the specific flow to each coil and lance. Pressure, flow and temperature transducers are provided to ensure proper acid pressure and flow as well as proper air temperature and flow. In addition, the vaporizing coils are also monitored for proper temperatures to ensure that the proper vaporization temperatures are being maintained at all times. A number of plant operating conditions can be used to determine the acid injection rates. These can be obtained by monitoring the electrostatic precipitator or from the chemical makeup of the flue gas stream being conditioned.

BRIEF DESCRIPTION OF THE DRAWINGS

The invention will now be described in greater detail with particular reference to the accompanying drawings which show a preferred embodiment of a flue gas conditioning system according to the invention and wherein:

FIG. 14 is a side elevational view of a skid used in the flue gas conditioning system shown in FIG. 13; and FIG. 15 is a top plan view of the skid shown in FIG. 14.

DESCRIPTION OF THE PREFERRED EMBODIMENTS

Figure 1:
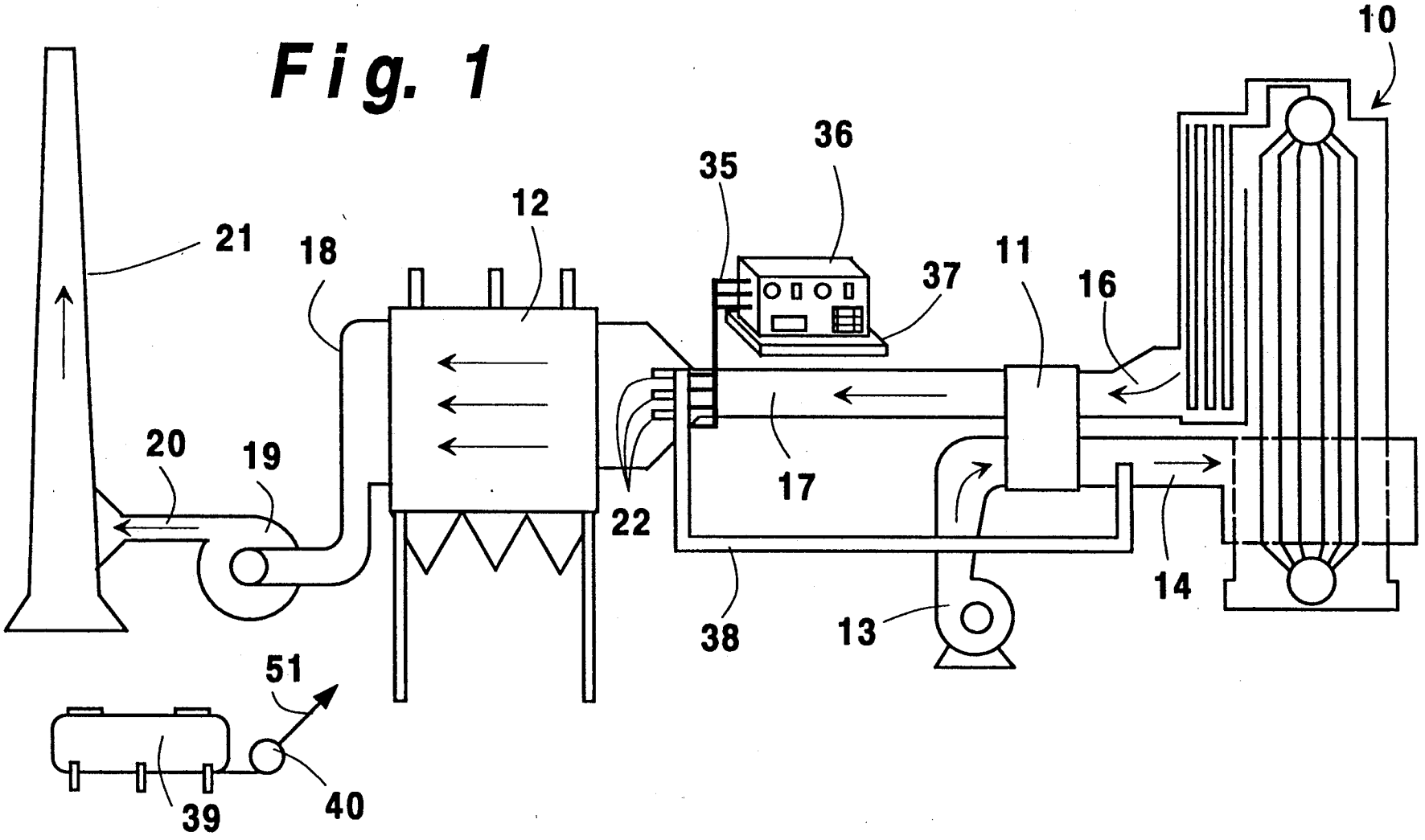
FIG. 1 is a schematic view of a typical power plant equipped with a flue gas conditioning system according to the invention.

Referring now to the accompanying drawings, it will be seen from FIG. 1 that a typical power plant equipped with a flue gas conditioning system according to the invention includes a boiler/combuster 10, an air preheater 11 and an electrostatic precipator 12. The air preheater 11 is disposed upstream from the boiler/combuster 10 while the electrostatic precipitator 12 is disposed downstream from the boiler/combuster 10. A forced draft fan 13 blows atmospheric air through the preheater 11 where the air temperature is raised typically to between about 550 and 650 degrees F. The preheated air passes from the preheater 11 via the inlet duct 14 to the boiler/combuster 10 where combustion of a fuel and air mixture takes place, producing heat energy for generating electricity. A flue gas heavily laden with finely-divided particles of fly ash is also produced by the combustion of the fuel/gas mixture which leaves the boiler/combuster 10 via outlet duct 16 and passes through the air preheater 11. In the preheater 11, the flue gas temperature drops typically to between about 250 and 350 degrees F, the heat extracted from the flue gas being transferred to the incoming atmospheric air. The flue gas then passes via the flue duct 17 to the electrostatic precipator 12 where the fly ash particles are removed. Upon leaving the precipator 12, the cleaned gas passes through the duct 18 to the induced draft fan 19 and then via the duct 20 to the stack 21 where it is released to the atmosphere at the stack outlet.

Figure 2:
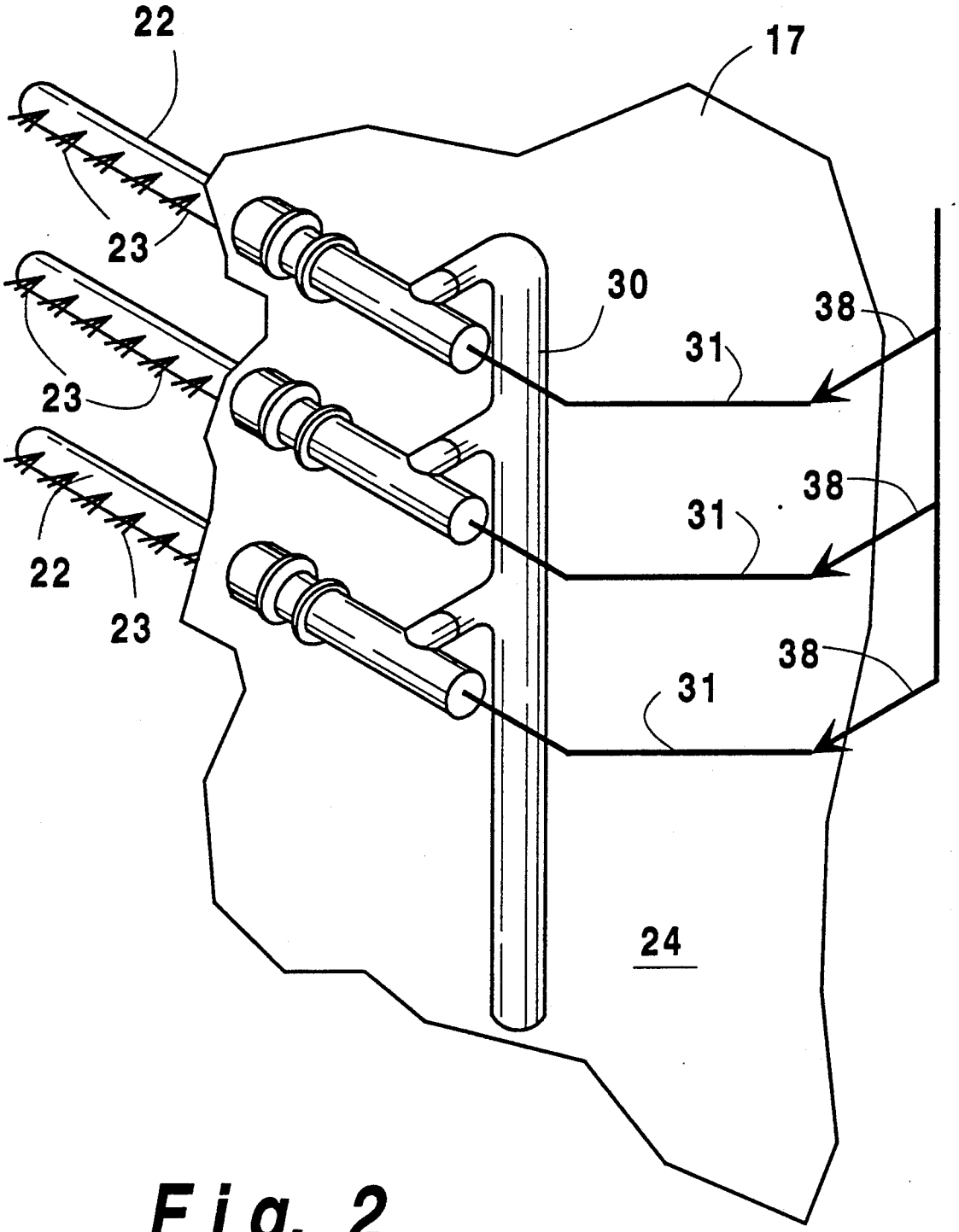
FIG. 2 is a perspective view of part of the flue duct in the power plant of FIG. 1 including three lances for injecting an acid conditioning agent according to the invention.

The flue gas conditioning system of the invention is installed in the power plant upstream from the electrostatic precipator 12. As best shown in FIG. 2, the system includes a plurality of elongated, tubular lances 22, there being three such lances shown in the embodiment illustrated, the lances 22 being mounted in spaced apart relationship across the flue duct 17 in a direction substantially perpendicular to the flow of flue gas therethrough. Each of the lances 22 is provided with a plurality of orifices 23 which are spaced apart along its forward end portion. Depending upon the particular plant, the lances 22 may be mounted horizontally in the flue duct 17 penetrating through its side wall 24 as shown in the illustrated embodiment or, in the alternative, the lances 22 may be mounted vertically in the flue duct 17 penetrating through its top wall.

Figure 5:
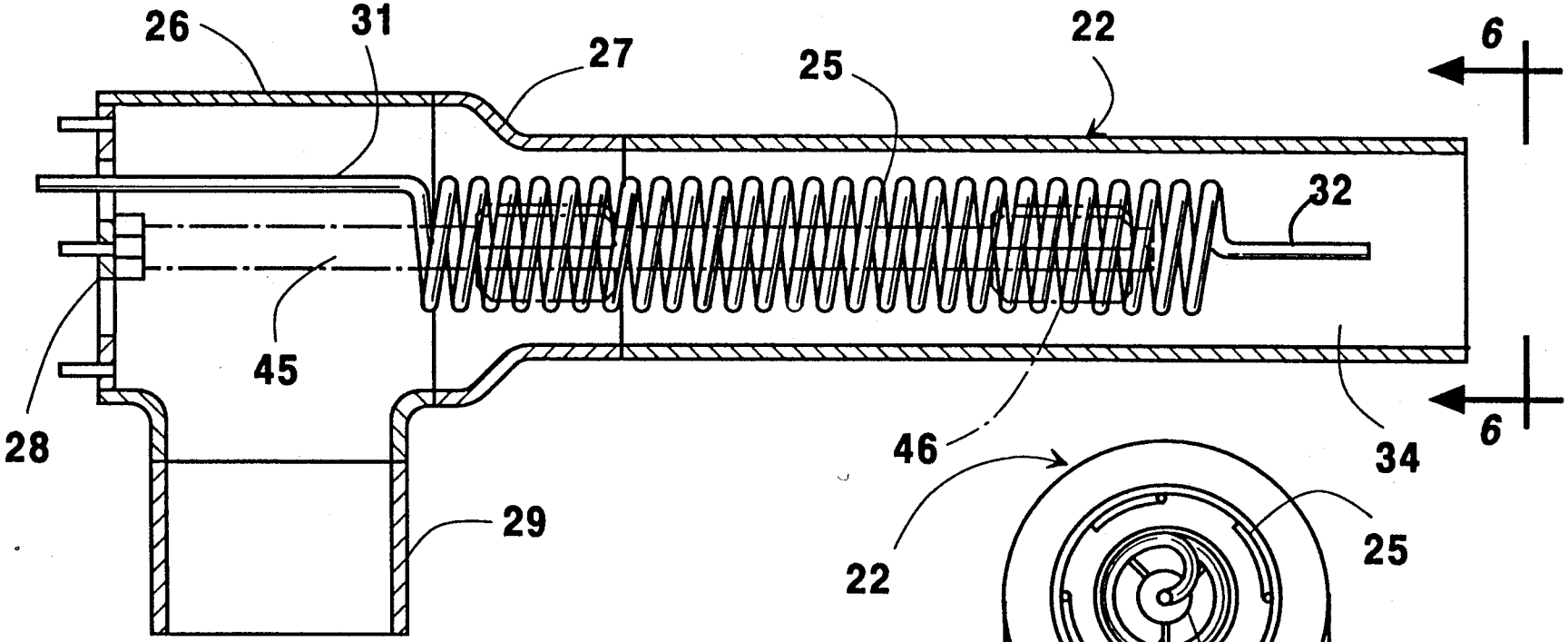
FIG. 5 is a side elevational view, partly in section, of the rearward end portion of the injection lance incorporating a vaporizing coil according to the invention.
Figure 6:
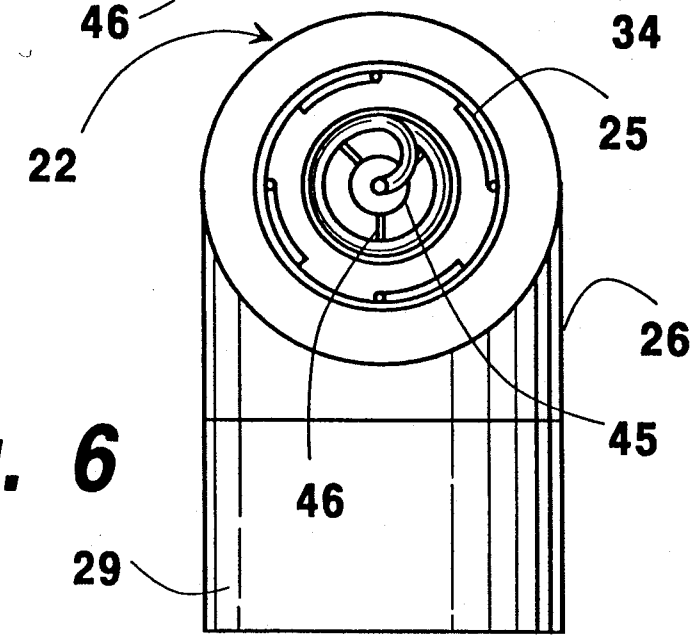
FIG. 6 is a sectional view of the injection lance taken along the line 6—6 in FIG. 5.

As shown in FIGS. 5 and 6, each of the tubular lances 22 has a heat exchange or vaporizing coil 25 mounted within its rearward end portion which forms an enclosure separating it from the flow of flue gas through the flue duct 17. The coil 25 is mounted within the tubular lance 22 by means of a hollow tee fitting 26. The tee fitting 26 is attached at one end to the lance 22 via a reducing coupling 27 and is closed at its opposite end by a cover plate 28. The bottom end of the tee fitting 26 is attached to a hot air pipe 29 which forms part of a hot air inlet manifold shown generally at 30 in FIG. 2.

Figure 7:
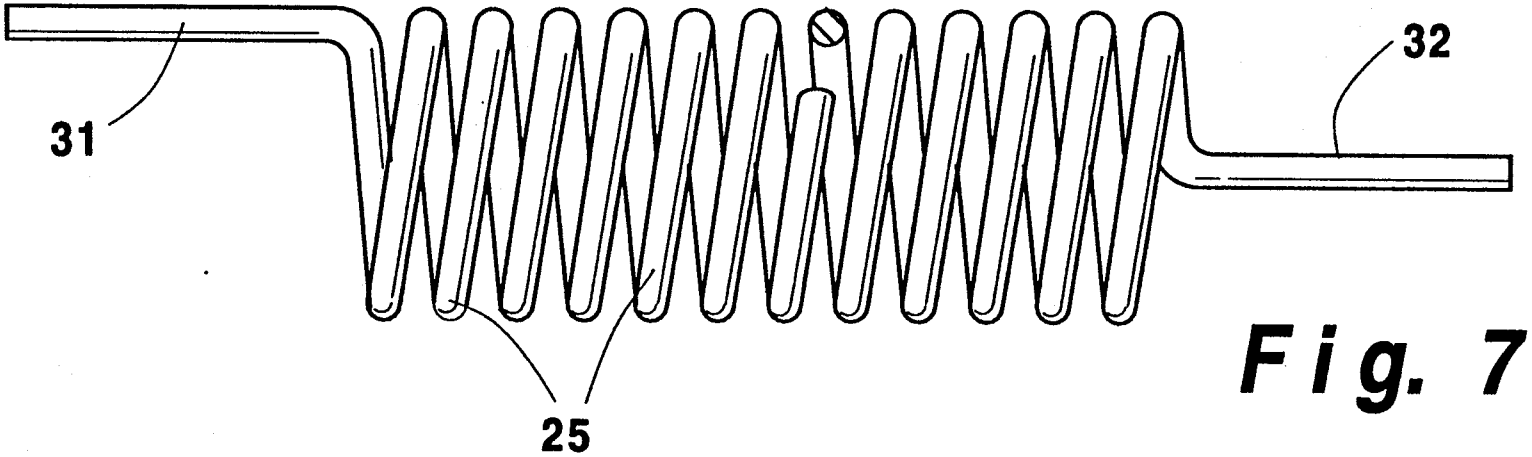
FIG. 7 is a side elevational view, partly broken away, of the vaporizing coil shown in FIGS. 5 an 6.
Figure 8:
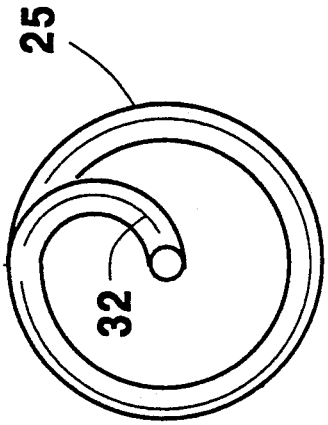
FIG. 8 is an end view of the vaporizing coil shown in FIG. 7.

The vaporizing coil 25 has a tubular inlet 31 at its rearward end which is offset from the center axis of the coil as best shown in FIG. 7. At its opposite forward end, the coil 25 has an outlet 32 which is positioned along the center axis of the coil as best shown in FIG. 8.

With further reference to FIGS. 5–8, inclusive, the inlet end 31 of the vaporizing coil 25 extends outwardly through the cover plate 28 and rearwardly from the lance 22. The outlet 32 at the opposite end of the vaporizing coil 25 is disposed adjacent to a mixing chamber 34 formed which is upstream from the orifices 23 in the forward end portion of the lance 22.

Turning again to FIGS. 1 and 2, acid supply pipes 35 carry a liquid acid conditioning agent, e.g. 93%–94%, sulfuric acid, from a system control shown generally at 36 to the inlet 31 of each vaporizing coil 25, there being three such supply pipes leading to the three individual lances 22 in the embodiment of the gas conditioning system illustrated. The control system 36, which will be described in detail hereinafter, is maintained on a conditioning skid 37 mounted nearby at a convenient location. A hot air supply pipe 38 communicates at one end with the inlet duct 14 and takes preheated air from downstream of the preheater 11 and carries the preheated air to the three lances 22 via the manifold assembly 30.

Hot air from the manifold assembly 30 enters the hollow tee fitting 26 on each lance 22 via the hot air pipe 29 and passes over the vaporizing coil 25 into the mixing chamber 34. The liquid acid from the supply pipe 35 enters the vaporizing coil 25 via the inlet 31 under pressure and is vaporized within the interior of the coil by the heat transferred from the hot air passing over the coil 25. The vaporized acid exits the coil 25 via its outlet 32 and enters the mixing chamber 34 where the acid vapor mixes thoroughly with the hot air after passing over the coil. The hot air/vapor mixture then flows into the forward end portion of the lance 22 where it is uniformly distributed via the lance orifices 23 into the flue gas stream passing through the flue duct 17.

The acid vapor condenses upon mixing with the cooler flue gas in the duct 17 wherein it combines with water vapor and is absorbed on the fly ash conditioning it for improved capture in the electrostatic precipitator 12. An acid supply tank 39 is maintained at a remote location which is accessible to supply trucks and rail cars, for example. A pump 40 transfers acid from the storage tank 39 to a smaller day tank 41 (FIG. 14) on the skid 37. Generally, transfer of acid occurs once or twice a day and may be initiated by automatic level switches or operator manual control.

Figure 3:
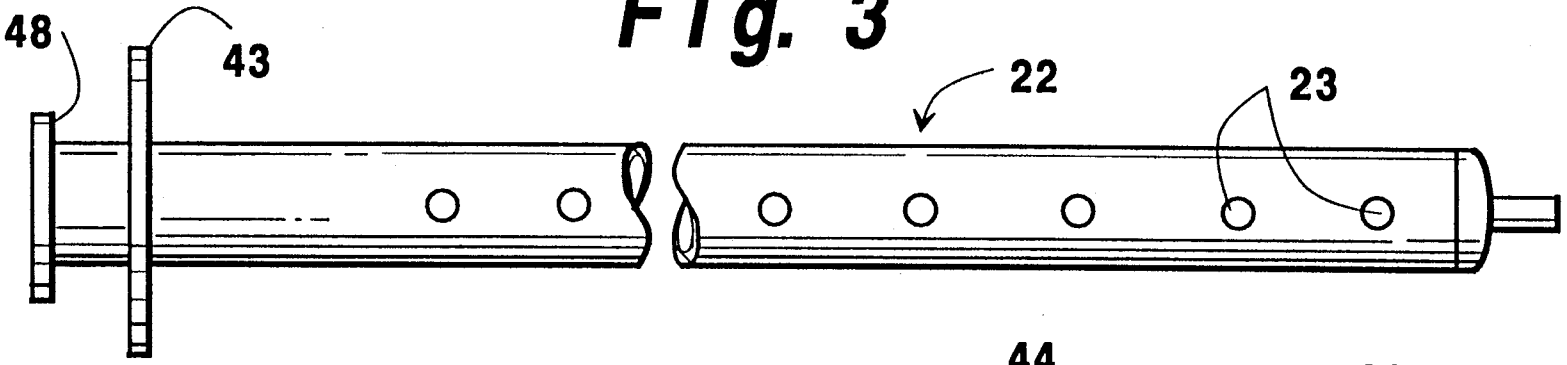
FIG. 3 is a side elevational view of one of the injection lances shown in FIG. 2.
Figure 11:
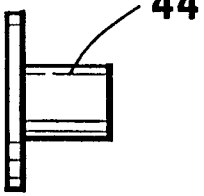
FIG. 11 is a side elevational view of an end support used for supporting an opposite end of each lance shown in FIG. 2.
Figure 12:
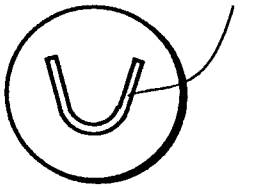
FIG. 12 is an end view of the lance support shown in FIG. 11.
Figure 9:
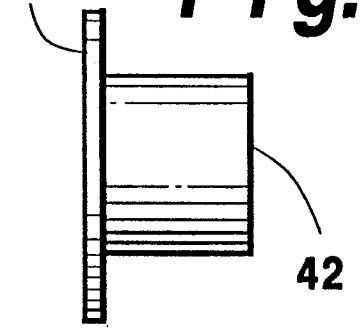
FIG. 9 is a side elevational view of a transition stub used for mounting each of the lances within the flue duct shown in FIG. 2.
Figure 10:
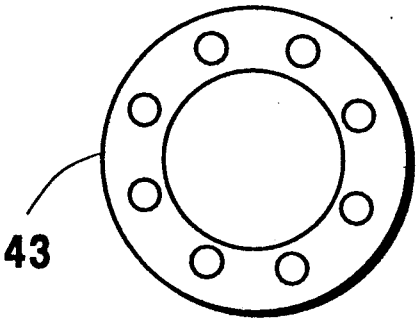
FIG. 10 is an end view of the transition stub shown in FIG. 9.
Figure 4:
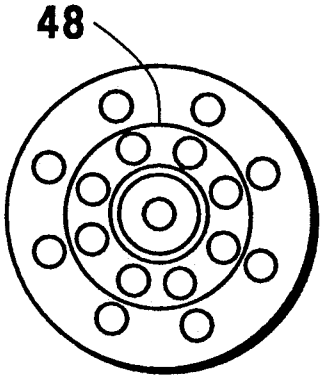
FIG. 4 is an end view of the injection lance shown in FIG. 3.

Each of the lances 22 is mounted in the side wall 24 of the flue duct 17 using a tubular transition stub 42 shown in FIGS. 9 and 10. The lance 22 is removably inserted through the stub 42 which is welded to the side wall 24. Preferably, the lance 22 is bolted in place by means of a gas tight flange 43 which is fixedly secured to the rear end of the lance as best shown in FIGS. 3 and 4. It will be seen by this construction that the lance 22 including the vaporizing coil 25 and the tee fitting 26 can be easily removed for servicing when desired. Each of the lances 22 is preferably made from stainless steel in order to resist corrosion from the acid vapor. The forward end of each lance 22 is also preferably supported by a generally U-shaped bracket 44 which is shown in FIG. 11 and 12. The bracket 44 is welded to the opposite side wall (not shown) of the flue duct 17 and can be made of carbon steel, for example.

As shown in FIGS. 5 and 6, the vaporizing coil 25 is preferably assembled within the hollow tee fitting 26 using a coil support rod 45. The support rod 45 is affixed at one end to the cover plate 28 and extends through the coil 25 along its center axis. The rod 45 has the function of supporting the coil 25 in a manner that allows the coil to expand and contract freely with temperature changes while keeping it on center. In addition, the support rod 45 helps to keeps the air flow from channeling down the center of the coil 25 and thus loosing valuable heat. The rod 45 is also preferably provided with fins 46 which both support the coil 25 and direct the flow of hot air over the coil. The vaporizing coil 25 is designed to have good air flow over its outside surface and to obtain optimum vaporizing performance. The coil 25 should be spaced apart from the interior side wall of the lance 22 so as to provide an annular passageway around the coil of sufficient size to insure maximum heating of the coil. Preferably, the outer diameter of the vaporizing coil 25 should be between about 0.7 and 0.85 of the interior diameter of the lance 22. The length of the coil 25 will generally vary depending upon several factors including the temperature and flow rate of the incoming hot air and the size or diameter of the coil itself. Suffice it to say that the coil should be of a length sufficient to provide a total surface area which will transfer enough heat through the coil to vaporize the liquid acid. The coil 25 is made of a corrosive resistant material which can accommmodate the acid such as tantalum or a ceramic material, for example.

As one example, a vaporizing coil made from 0.50 inch diameter tantalum tubing and having an outside radius of about 2.25 inches and a length of about 1.5 feet (actual coiled length of about 30 feet) will provide good performance when used in a typical power plant employing injection lances measuring 6 inches in diameter and 15 feet in length. If desired, an inert packing material such as short rods (not shown) can be placed in the coil 25 to improve conditioning agent contact with the hot wall and enhance heat transfer.

It will be seen from the above construction that the cover plate 28, vaporizing coil 25 and support rod 45 are all assembled so that they can be easily removed as one unit for inspection and service when desired. Moreover, it should be noted that the cover plate 28 may also be provided with means for running various instrumentation (not shown) to the coil 25 such as a temperature sensor in order to monitor its performance and provide an alarm for a low temperature condition. Preferably, the hollow tee fitting 26 is provided with a flange or other means at its outlet end to facilitate its attachment and removal to the lance 22 via the flange 48 as shown in FIG. 3.

Figure 13:
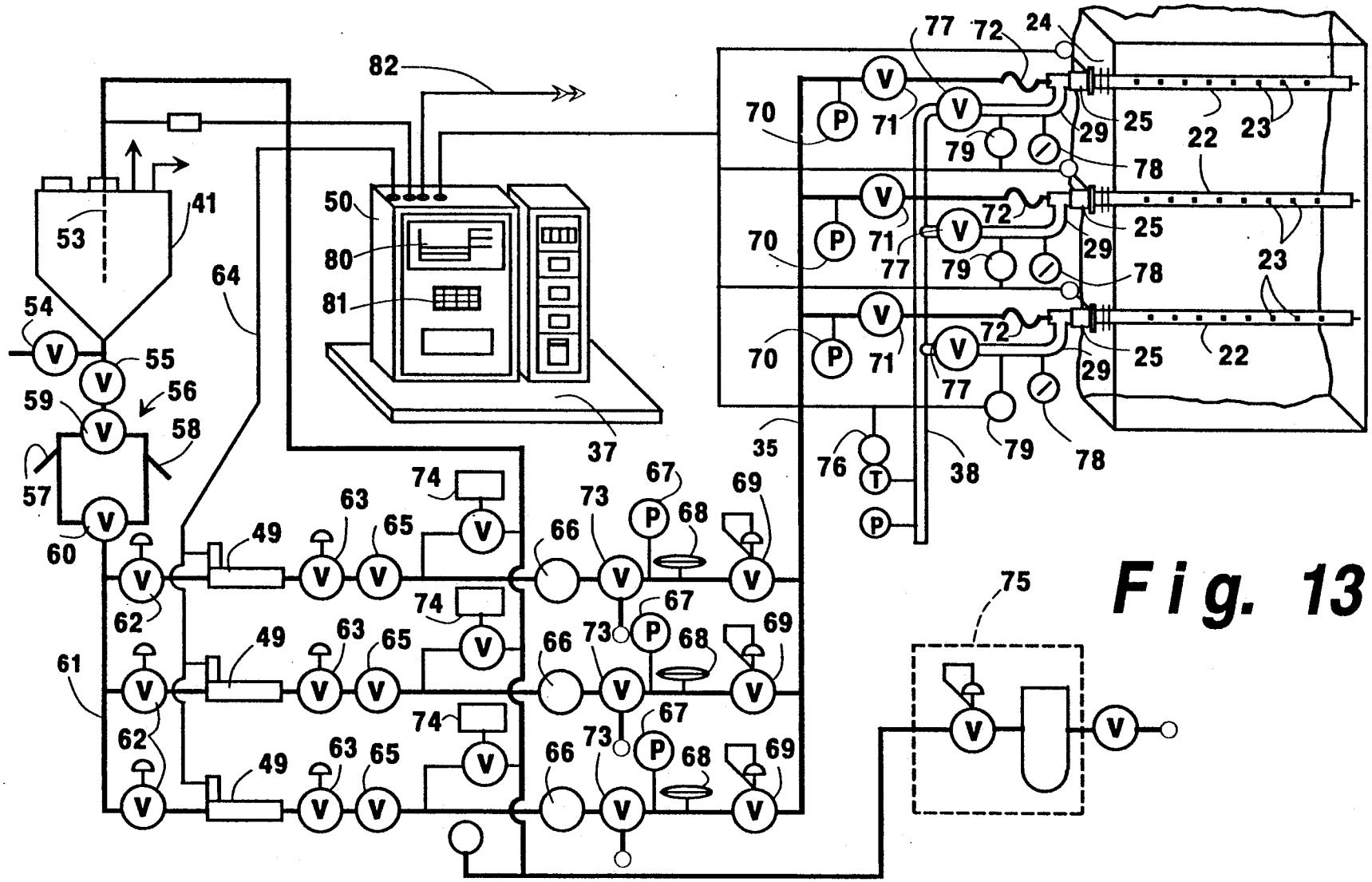
FIG. 13 is a schematic flow diagram of the flue gas conditioning system according to the invention.

Having described the vaporizing coil 25 and its construction and assembly into each tubular injection lance 22, it is now in order to disclose the control system and operation of the improved gas conditioning system of the invention. Particular reference will be made in the following description to FIG. 13 which shows a flow diagram of the gas conditioning system and to FIGS. 14 and 15 which illustrate the conditioning skid 37 and its components including the day tank 41, pumps 49 and a microprocessor unit 50. In FIG. 13, the piping and instrumentation for the three vaporizing coil-lance system are illustrated. The acid is supplied to the day tank 41 from the storage tank 39 via the pipe 51 and pump 40 (see FIG. 1). The acid level in the day tank 41 is measured and controlled by a bubbler type level sensor 53 which is connected to the system air supply. The day tank 41 has a drain 54 and a shut off valve 55. Following the acid flow out of the day tank 41, the acid flows into a duplex filter set shown generally at 56 to remove any solid particles. Two filters 57, 58 are provided, one of which can be cleaned while the other is on stream by means of valves 59, 60. From the filter set 56, the acid flows through pipe 61 to three metering pumps indicated at 49, there being one pump provided for each vaporizing coil 25 for individual control. Each pump 49 can be isolated by a pair of shut-off valves 62, 63 and removed for replacement or repair without affecting the operation of the other pumps in the system. The metering pumps 49 move a measured amount of acid which is set by a signal sent to each of them via an electrical lead 64 from the microprocessor unit 50. The acid flows from each pump 49, through a check valve 65, flow transducer 66 which informs the microprocessor unit 50 of the acid flow rate, a local indicating pressure gauge 67, a pulsation dampener 68 to smooth out the flow rate, and a back pressure regulator 69 which provides an hydraulic head for operating the pumps. In some systems with sufficient head, the back pressure regulator 69 can be eliminated. From this point, the acid leaves the conditioning skid 37 and enters the supply pipe 35 leading to the individual vaporizing coils 25 which typically can be several hundred feet away from the skid 37. At a location close to each vaporizing coil 25, the acid supply pipe 35 has a local pressure indicator 70, shut off valve 71 and an armored flex-hose 72 which attaches to the coil inlet 31 and prevents excess force from being applied to the coil 25. Once the acid enters the coil 25, it is vaporized, exits the coil outlet 32 and enters the mixing chambers 34 where the acid vapor and hot air mix prior to being distributed through the orifices 23 into the flue gas stream.

Also provided on the skid 37 is a purge system using compressed air to force acid out of the supply pipe 35 prior to a long shut down. The acid can be either forced out through the vaporizing coils 25 or through a drain tap (not shown) which is connected in the acid supply pipe 35 with a three-way valve 73. This valve 73 can also be used to divert the acid flow into a graduated container to verify the acid flow rate. A solenoid valve 74 controls the air flow for purging and an air pressure regulator-filter 75 prevents excessive air pressure and contamination from dirty air.

The hot air supply is monitored for both pressure and temperature by the control system. For this purpose, a temperature transducer 76 is provided in the supply pipe 38 (FIG. 1) producing a signal which is sent back to the microprocessor unit 50. The hot air pipe 29 connected to each vaporizing coil 25 is provided with a manual set flow trim valve 77 and flow measuring instrumentation 78. Each pipe 29 is also provided with an air flow switch 79 which the microprocessor unit 50 reads to generate a low flow alarm signal. The coil outlet 32 is also monitored with a temperature transducer (not shown) to detect a low vaporizing temperature. This signal also is communicated to the microprocessor unit 50.

The microprocessor unit 50 is preferably provided with a CRT display 80 and a keypad input 81. The microprocessor unit 50 allows each system to be individually configured for the particular plant or customer. In general, graphic displays will show operating conditions of the flue gas conditioning system and plant, trend lines for various functions, control and alarm set points, and alarm conditions if any should exist. The microprocessor unit 50 receives input signals or data on the input leads 82 from the plant and uses these input signals to generate a control signal representing the acid flow rate which is set via the lead 64 to the metering pumps 49 which then pump the optimum amount of acid. The microprocessor unit 50 will display and/or control the level of acid in the day tank 41, acid flow rate, hot air temperature, hot air low flow condition in the individual supply pipe 29 to each vaporizing coil 25, coil operating temperature, and plant conditions, e.g., typically boiler load, stack opacity, flue gas flow rate and temperature.

The optimum acid injection rate for the gas conditioning system of the invention is the one that produces the best results in fly ash collection without overconditioning. This rate is generally between about 15–30 ppm acid to flue gas. The exact ratio will vary, however, with the flue gas rate, the coal analysis, plant operation, precipitator condition and other variables.

A typical example of determining and controlling the acid injection rate is described below:

For a given coal, the plant is operated at full rate and the acid injection is increased to the point of maximum precipitator collection efficiency as determined by observing the stack plume appearance, observing the precipitator electrical performance parameters and/or taking flue gas samples. After the correct rate for the plant at full load is known, a signal is provided to the conditioning unit by the plant which is proportional to the flue gas flow rate and should provide automatic injection of the correct amount of acid. This signal is transmitted to the control system which adjusts the pumping rate accordingly and permits the acid injection rate to drop proportionately to any drop in the flue gas flow rate. Thus, the amount of acid being injected can be kept in constant proportion to the flue gas. If a plant is operated near full load most of the time and uses a single type of coal, the aforementioned control system is very dependable. If the plant burns several types of coals with different optimum acid injection rates for the different coals, a more sophisticated control system, such as one dependent on the sulfur trioxide content of the flue gas, and the stack opacity can be used.

It is important to preclude acid condensation on the duct or precipitator surfaces since such condensation is highly corrosive. Accordingly, a temperature transducer (not shown) can be provided to monitor the flue gas temperature and send a signal to the microprocessor unit 50, reducing or eliminating the acid injection should the temperature fall below a certain point. The critical point is the acid dew point in the flue gas. Dew points typically range from about 250 degrees F to about 285 degrees F. The set point is generally fixed at somewhat above the dew point for the particular plant, depending on the plant operating conditions.

What is claimed is:

1. Method of injecting a conditioning agent into a flue gas stream for enhancing the removal of finely divided-fly ash particles by electrostatic precipitation comprising the steps of:

passing a liquid conditioning agent through a hollow vaporizing coil mounted within an enclosure defining a mixing chamber downstream from said coil, said coil having an outlet communicating with said mixing chamber;

passing a stream of hot air through said enclosure and into contact with said coil, said stream of hot air having a temperature greater than the boiling point of said liquid acid conditioning agent such that the heat transferred through said coil vaporizes said liquid conditioning agent before reaching said outlet;

mixing the vaporized acid conditioning agent with said stream of hot air in said mixing chamber; and passing the resulting vapor-hot air mixture from said mixing chamber into contact with said flue gas stream.

2. The method of claim 1 wherein said enclosure is formed within one portion an elongated tubular lance and wherein said vapor-hot air mixture is distributed uniformly into, contact with said flue gas stream by at least one orifice located within another portion of said lance.

3. The method of claim 1 wherein said acid conditioning agent is sulfuric acid.

4. The method of claim 3 wherein said sulfuric acid is injected at a rate of 10–45 ppm acid to flue gas.

5. The method of claim 1 wherein the quantity of said acid conditioning agent supplied to said coil can be varied independently to effect a desired acid vapor distribution in an area downstream from said lance in said stream of flue gas.

6. The method of claim 1 wherein the quantity of said acid conditioning agent supplied to said coil is automatically varied with changes in the flow rate of said flue gas stream.

7. The method of claim 1 wherein the opacity of said stream of flue gas is continuously monitored and wherein the quantity of acid conditioning agent supplied to said coil is automatically varied to maintain a predetermined opacity reading.

8. The method of claim 1 wherein the volume of hot air passed through said enclosure is maintained constant while the quantity of acid conditioning agent supplied to said coil is varied.

9. The method of claim 1 wherein the vaporized acid conditioning agent in said coil is introduced into said mixing chamber at a location downstream from said outlet a distance no more than 10 diameters of that portion of said tubular lance forming said mixing chamber.

10. Apparatus for injecting an acid vapor into a flue gas stream for enhancing the removal of fly ash particles by electrostatic precipitation comprising, in combination: at least one vaporizing coil mounted within an enclosure defining a mixing chamber downstream from said coil, said coil having an outlet communicating with said mixing chamber; means for passing a liquid acid conditioning agent through said coil; means for passing a stream of hot air through said enclosure and into contact with said vaporizing coil whereby heat transferred through said coil vaporizes said acid conditioning agent before reaching said outlet; and means for distributing the resulting vapor-hot air mixture from said mixing chamber into contact with said flue gas wherein said means for distributing said vapor-hot air mixture comprises an elongated tubular lance having at least one orifice communicating between said mixing chamber and said flue gas stream.

11. Apparatus according to claim 10 wherein said enclosure is formed at least partly by a first portion of said tubular lance and wherein a plurality of said orifices are provided within an opposite second portion of said lance.

12. Apparatus according to claim 11 wherein a hollow tee fitting is attached at one end to said tubular lance and wherein said vaporizing coil is mounted partly within said tee fitting and partly within said tubular lance.

13. Apparatus according to claim 12 wherein said tee fitting is closed at its opposite end by a cover plate and wherein said vaporizing coil is held axially within said tee fitting and said lance by an elongated rod affixed to said cover plate.

14. Apparatus according to claim 13 wherein said vaporizing coil has an inlet extending through said cover plate and wherein said outlet lies along the center axis of said coil.

15. Apparatus according to claim 13 wherein said vaporizing coil is spaced apart from the interior wall of said tubular lance defining a passageway for the flow of hot air over said coil and wherein said rod is provided with a series of fins for diverting the flow of hot air into said passageway.

16. Apparatus according to claim 10 wherein said vaporizing coil is made of tantalum or a ceramic material.

17. In a power plant including a combuster/boiler having an inlet and an outlet, an air preheater disposed upstream from said combuster/boiler inlet and an electrostatic precipitator disposed downstream from said combuster/boiler, the combination therewith of an acid conditioning system for injecting an acid vapor into a stream of flue gas produced by said combuster/boiler thereby to enhance the removal of fly ash particles therefrom prior to entering said electrostatic precipitator comprising, in combination:

at least one vaporizing coil mounted within an enclosure defining a mixing chamber downstream from said coil, said coil having an outlet communicating with said mixing chamber;

means for passing a liquid acid conditioning agent through said coil;

means for passing a stream of hot air through said enclosure and into contact with said vaporizing coil whereby heat transferred through said coil vaporizes said acid conditioning agent before reaching said outlet; and means for distributing the resulting vapor-hot air mixture from said mixing chamber into contact with said flue gas wherein said means for distributing said vapor-hot air mixture comprises an elongated tubular lance having at least one orifice communicating between said mixing chamber and said flue gas stream.

18. The combination according to claim 17 wherein said stream of hot air is taken from said preheater at a point between said preheater and said inlet of said combuster/boiler.

19. The combination according to claim 18 further including means for monitoring the content of fly ash particles in said flue gas stream and for automatically varying the quantity of said acid conditioning agent distributed into said flue gas stream.

20. The combination according to claim 18 further including means for monitoring the flow rate of said stream of flue gas and for automatically varying the quantity of said acid conditioning agent distributed into said flue gas stream.

* * * * *